US009074780B2

(12) United States Patent
Lee et al.

(10) Patent No.: US 9,074,780 B2
(45) Date of Patent: Jul. 7, 2015

(54) AIR CONDITIONER WITH ROTATING HEAT EXCHANGER

(75) Inventors: Juhyoung Lee, Seoul (KR); Deok Huh, Seoul (KR); Seongwon Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 906 days.

(21) Appl. No.: 12/895,192

(22) Filed: Sep. 30, 2010

(65) Prior Publication Data

US 2011/0277971 A1 Nov. 17, 2011

(30) Foreign Application Priority Data

May 13, 2010 (KR) ..... 10-2010-0044792
May 13, 2010 (KR) ..... 10-2010-0044793

(51) Int. Cl.

| | |
|---|---|
| ***F24H 3/06*** | (2006.01) |
| ***F28F 5/00*** | (2006.01) |
| ***F28D 11/00*** | (2006.01) |
| ***F25D 23/12*** | (2006.01) |
| ***F25D 23/00*** | (2006.01) |
| ***F25D 17/06*** | (2006.01) |
| ***F24F 1/00*** | (2011.01) |
| *F24F 13/20* | (2006.01) |

(52) U.S. Cl.

CPC ..... *F24F 1/0059* (2013.01); *F24F 2013/205* (2013.01)

(58) Field of Classification Search

CPC ..... F28D 11/04; F28D 1/024
USPC ..... 62/262, 263, 302, 428; 165/86, 122
See application file for complete search history.

(56) References Cited

U.S. PATENT DOCUMENTS

| | | | | |
|---|---|---|---|---|
| 4,076,072 | A * | 2/1978 | Bentz | 165/41 |
| 5,386,873 | A * | 2/1995 | Harden et al. | 165/47 |
| 5,547,018 | A * | 8/1996 | Takahashi et al. | 165/267 |
| 5,669,229 | A * | 9/1997 | Ohbayashi et al. | 62/259.1 |
| 5,758,719 | A * | 6/1998 | Yoshihashi et al. | 165/119 |
| 6,244,954 | B1 * | 6/2001 | Hosokawa et al. | 454/315 |
| 6,435,264 | B1 * | 8/2002 | Konno et al. | 165/41 |
| 6,621,707 | B2 * | 9/2003 | Ishimine et al. | 361/721 |
| 7,225,862 | B2 * | 6/2007 | Chin et al. | 165/133 |
| 7,518,865 | B2 * | 4/2009 | Anderl et al. | 361/695 |
| 8,085,537 | B2 * | 12/2011 | Harris | 361/695 |

(Continued)

FOREIGN PATENT DOCUMENTS

| | | |
|---|---|---|
| CN | 1392367 | 1/2003 |
| CN | 1509393 | 6/2004 |

(Continued)

OTHER PUBLICATIONS

European Search Report issued in EP Application No. 10175917.3 dated Jul. 15, 2011.

(Continued)

*Primary Examiner* — Judy Swann
*Assistant Examiner* — Claire Rojohn, III
(74) *Attorney, Agent, or Firm* — Ked & Associates, LLP

(57) ABSTRACT

An air conditioner is provided. A location of, an angle between, or a distance between, a heat exchanger and a blower may be varied based on whether or not the air conditioner is operating. A number of drivers for moving the heat exchanger and/or the blower may be reduced and reliability of the driver be enhanced. Size of the air conditioner may be reduced, and efficiency may be improved.

20 Claims, 16 Drawing Sheets

(56) References Cited

U.S. PATENT DOCUMENTS

| | | | | |
|---|---|---|---|---|
| 2005/0056039 | A1* | 3/2005 | Kim et al. | 62/262 |
| 2005/0235679 | A1* | 10/2005 | Lee et al. | 62/412 |
| 2005/0279116 | A1* | 12/2005 | Park et al. | 62/317 |
| 2006/0032198 | A1* | 2/2006 | Cha et al. | 55/418 |
| 2007/0060036 | A1* | 3/2007 | Shibuya et al. | 454/187 |
| 2007/0151720 | A1* | 7/2007 | Maeda | 165/202 |
| 2008/0135209 | A1* | 6/2008 | Lowe et al. | 165/77 |
| 2008/0185125 | A1* | 8/2008 | Prior | 165/86 |
| 2009/0107167 | A1* | 4/2009 | Kim et al. | 62/426 |
| 2010/0084115 | A1* | 4/2010 | Sung | 165/63 |
| 2011/0005734 | A1* | 1/2011 | Nanaumi et al. | 165/122 |
| 2011/0048050 | A1* | 3/2011 | Moteki et al. | 62/263 |
| 2011/0277495 | A1* | 11/2011 | Lee et al. | 62/428 |

FOREIGN PATENT DOCUMENTS

| | | |
|---|---|---|
| CN | 101490495 | 7/2009 |
| EP | 1 835 236 | 9/2007 |
| EP | 2 048 465 | 4/2009 |
| KR | 10-2008-0070406 | 7/2008 |
| WO | WO 2007/132720 | 11/2007 |

OTHER PUBLICATIONS

Chinese Office Action issued in CN Application No. 201010509476.X dated Apr. 12, 2013.

* cited by examiner

AIR CONDITIONER WITH ROTATING HEAT EXCHANGER

CROSS-REFERENCE TO RELATED APPLICATION(S)

This application claims the benefit of the Korean Patent Applications No. 10-2010-0044792, filed on May 13, 2010, and No. 10-2010-0044793, filed on May 13, 2010, which are hereby incorporated by reference as if fully set forth herein.

BACKGROUND

1. Field

This relates to an air conditioner.

2. Background

Generally, an air conditioner adjusts air temperature, humidity and the like to be suitable for a specific area. An air conditioner may include a compressor and a heat exchanger that provide heating/cooling by circulating refrigerant. Air conditioners may be classified into all-in-one type air conditioners and separate type air conditioners. The components of an all-in-one type air conditioner are built in one body and installed, for example, in a wall or in a window. A separate type air conditioner may include an indoor unit having a heat exchanger for cooling or heating a designated space and an outdoor unit having a compressor and a heat exchanger for exchanging heat with outdoor air. In this case, the indoor unit and the outdoor unit are separated from each other and connected by refrigerant pipes, and installed indoors and outdoors, respectively.

In general, an indoor unit of a separate type air conditioner may include a housing having an air inlet and an air outlet, a compressor provided within the housing to compress a refrigerant, a heat exchanger configured to perform heat exchange, and a fan configured to generate air flow within the indoor unit. The indoor unit may have a prescribed width, height and thickness to provide an installation space for the heat exchanger and the fan.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to air conditioners according to embodiments as broadly described herein, examples of which are illustrated in the accompanying drawings. Wherever possible, the same reference numbers will be used throughout the drawings to refer to the same or like parts and redundant descriptions omitted. Simply for clarity, sizes and shapes of parts may be exaggerated or reduced. Although terminology including ordinal numbers such as first, second and the like may be used in describing various parts, the corresponding part is non-limited by this terminology. Rather, the terminology may simply be used to discriminate one part from another.

Figure 1:
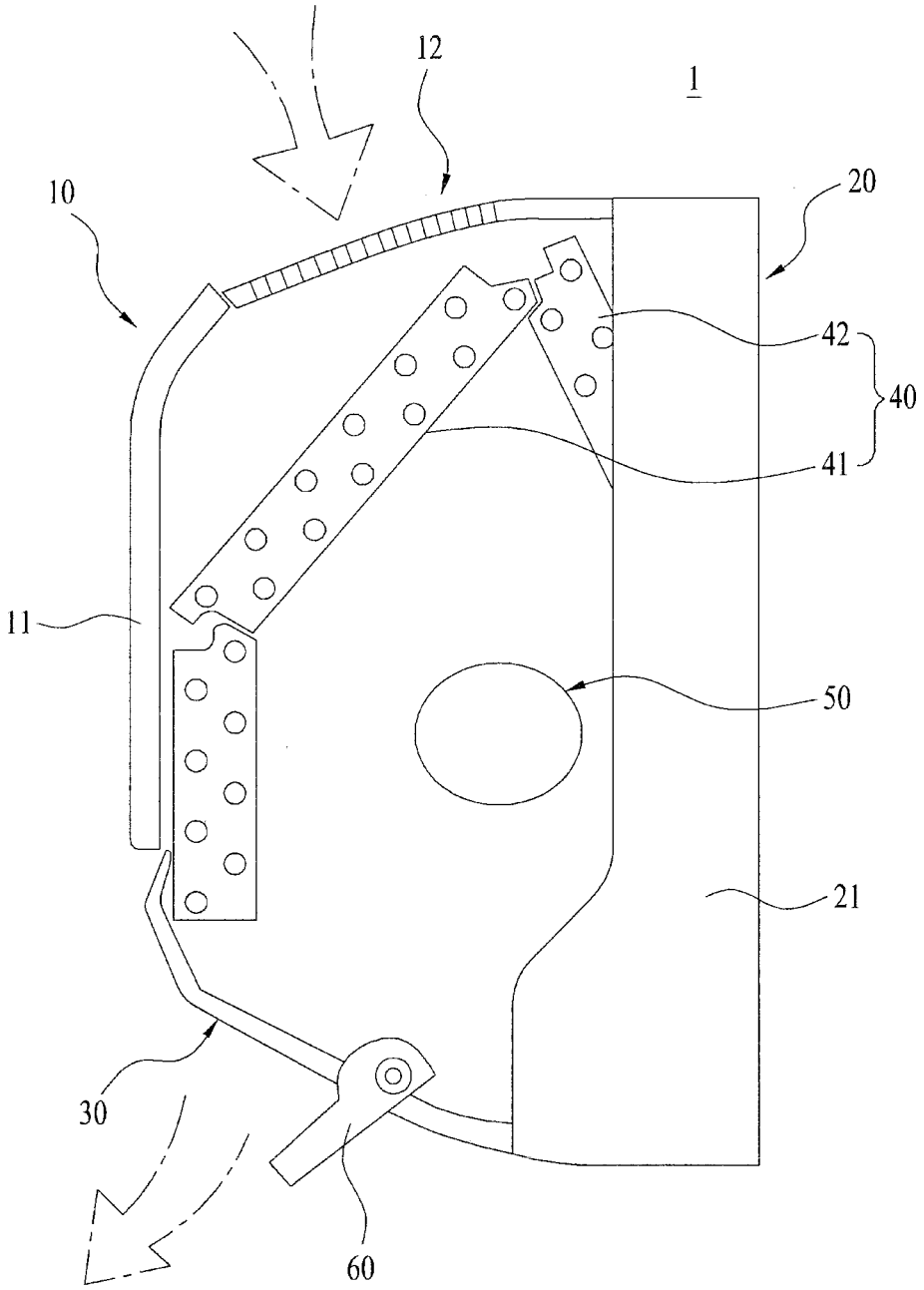
FIG. 1 is a cross-sectional view of an exemplary air conditioner.

Referring to FIG. 1, an exemplary air conditioner 1 may include a housing in which various components are received. The housing may include a front housing 10 that defines a front exterior portion of the housing and a rear housing 20 that defines a rear exterior portion of the housing. Various components are received in a space defined by the front housing 10 and the rear housing 20. In certain embodiments, a lateral housing may extend between the front housing 10 and the rear housing 20 to define lateral sides of the housing.

The front housing 10 may include a front panel 11 that covers a front portion of the housing and the components within the air conditioner 1 to prevent them from external exposure. In certain embodiments, the front panel 11 may be integral with the front housing 10. One end potion of the front panel 11 may be rotatably connected to the front housing 10 so as to be closed or open against the front housing 10 based on activation or deactivation of the air conditioner 1. Alternatively, the front panel 11 may be connected to enable a forward/backward translation with a predetermined gap against the front housing 10.

The rear housing 20 may include a rear panel 21 configured to be hung on or fixed to a wall of an installation space. A gap, or distance, between the front panel 11 and the rear panel 21 may be adjusted so as to adjust an interior volume of the housing accordingly. In particular, the front housing 10 and the rear housing 20 may be connected to each other such that a volume of an inner space of the housing in which the components are received may be selectively increased or decreased. During operation, the inner space of the housing may be increased so as to arrange components 40 and 50 received therein at positions suitable for an air conditioning operation. When the air conditioner 1 is deactivated, the inner space may be decreased to minimize a volume occupied by the housing by varying a gap between the components 40 and 50 and relative positions of the components 40 and 50 received therein.

For instance, the front housing 10 and the rear housing 20 may be connected to each other so as to enable the front housing 10 to translate relative to the rear housing 20 in a horizontal direction. Alternatively, the front housing 10 and the rear housing 20 may be connected to each other so as to enable the front housing 10 to translate relative to the rear housing 20 in a vertical direction. Alternatively, the front housing 10 and the rear housing 20 may be connected to each other so as to enable the front housing 10 to rotate relative to the rear housing area 20.

An appropriate translational or rotational motion mechanism may be selected in consideration of the design of the front and rear housings 10 and 20. A single motion mechanism may be used, or two or more motion mechanisms may be combined together, as appropriate. If the housing includes either the front panel 11 or the rear panel 21, one or more such motion mechanisms may be applied to the front panel 11 or the rear panel 21 to increase or decrease the space therebetween.

The housing may include at least one air inlet 12 and at least one air outlet 30 provided at various positions. For instance, the air inlet 12 may be provided at the front panel 11, or at a top side of the housing, or at a lateral side of the housing. If the front panel 11 is rotatably connected to the front housing 10, a space formed between the front panel 11 and the front housing 10 when the front panel 11 is rotated away from the front housing 10 may serve as the air inlet 12. The air outlet 30 may be spaced apart from the air inlet 12 to prevent interference between the air being introduced into the housing through the air inlet 12 and the air being discharged from the housing through the air outlet 30. FIG. 1 shows that the air inlet 12 is provided at the top of the housing and the air outlet 30 is provided at a bottom portion of the front housing 10. Other arrangements may also be appropriate.

The air conditioner 1 may also include a direction control mechanism 60 that guides a flow of air discharged via the air outlet 30 and also adjusts a direction of the discharged air. In certain embodiments, the direction control mechanism 60 may include right and left control members configured to control a right/left direction of the air passing through the air outlet 30, and/or an upper and lower control member configured to control an upward/downward direction of the air passing through the air outlet 30. The direction control mechanism 60 shown in FIG. 1 employs an upper and lower control member for controlling the upward/downward flow direction.

The components received in the housing of the air conditioner 1 may include a heat exchanger 40 that may be rotatably linked to the front panel 11 or the rear panel 21. In FIG. 1, the air conditioner is in an activated state for performing an air conditioning operation. The heat exchanger 40 may include a plurality of heat exchangers to increase a heat-exchange surface thereof, such as, for example, a front heat exchanger 41 and a rear heat exchanger 42. Such a pair of heat exchangers 41 and 42 may be positioned adjacent to each other and connected so as to enable an angle between the heat exchangers 41 and 42 to change or to be fixed as necessary. In the following description, simply for ease of discussion, it is assumed that the heat exchanger 40 (the rear heat exchanger 42 in FIG. 1) is rotatably linked to the rear panel 21. Other arrangements may also be appropriate.

The components received in the housing of the air conditioner 1 may also include a blower 50 having a fan 51 positioned in a fan housing 52 to control air flow in the housing. The blower 50 draws in air via the air inlet 12 and then discharges the air via the air outlet 30. For example, in a cooling mode of the air conditioner 1, the air drawn in through the air inlet 12 is cooled as it passes through the heat exchanger 40 and then the cooled, heat exchanged air is discharged out into a room space via the air outlet 30. The fan 51 may be, for example, a sirocco fan, a propeller fan, a turbo fan, a cross-flow fan, or other type of fan as appropriate. Optionally, a plurality fans may be installed in the fan housing 52.

The air conditioner 1 may also include a driver configured to move, or rotate, at least one of the heat exchanger 40 and/or the blower 50.

In the following description, various embodiments for the heat exchanger and/or the blower are moved within the housing by the driver based on whether or not indoor unit is operating. One or more drivers may be used to control movements of the heat exchanger and the blower. In the interest of reducing power consumption and maximizing efficiency, after the heat exchanger 40 and the blower 50 are interlocked, a least one of the heat exchanger 40 or the blower 50 may be moved by at least one driver.

Figure 2A:
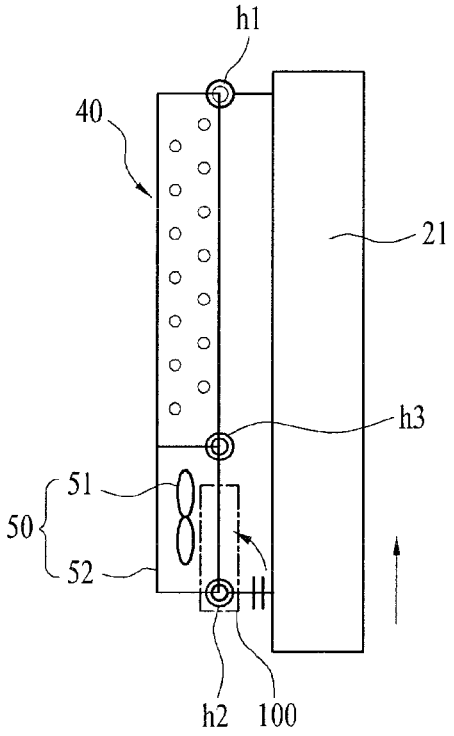
FIGS. 2 to 5 are cross sectional views of drive systems of an air conditioner as embodied and broadly described herein.
Figure 2B:
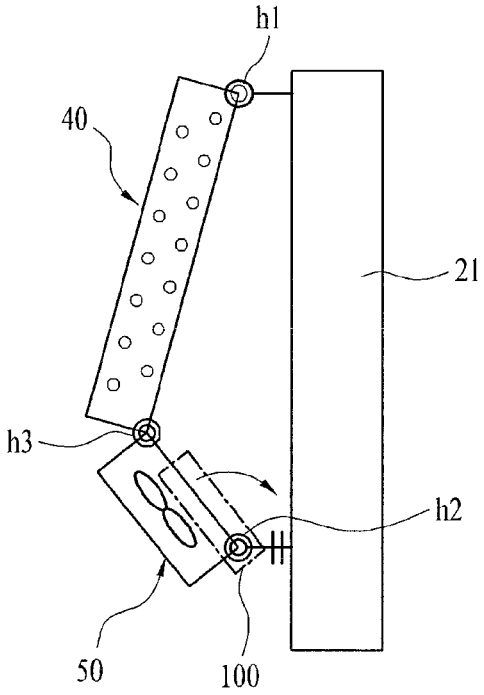

In the embodiment shown in FIGS. 2A-2B, the heat exchanger 40 and the blower 50 are rotatably linked to each other, and a driver 100 rotates the blower 50. FIG. 2A shows that the heat exchanger 40 and the blower 50 are substantially vertically aligned when the air conditioner is not operating. FIG. 2B shows that the heat exchanger 40 and the blower 50 rotate relative to each other when the air conditioner is operating.

Adjacent end portions of the heat exchanger 40 and the fan housing 52 of the blower 50 may be rotatably linked with each other via a hinge h3. The other end portions of the heat exchanger 40 and the fan housing 52 may be rotatably linked with the rear panel 21 via the hinges h1 and h2 provided at the rear panel 21, respectively.

At least one of the hinge h1 (between the heat exchanger 40 and the rear panel 21) or the hinge h2 (between the fan housing 52 and the rear panel 21) may slide along a vertical direction of the rear panel 21. To provide for such a slide movement, a guide rail 22 (see FIG. 3) may be provided on the rear panel 21, arranged the vertical direction. The at least one of the hinges h1 or h2 may include a guide projection that engages the guide rail.

The driver 100 may rotate the hinge h2 between the fan housing 52 and the rear panel 21. For example, the driver 100 may include a motor and a driving gear connected to the motor. A driven gear may be connected to one end portion of a hinge shaft of the hinge h2. While the driving gear and the driven gear engage with each other, the hinge shaft of the hinge h2 is rotated by the motor to move the lower end of the fan housing 52 vertically along the rear panel 21 and rotate the fan housing 52 as shown in FIG. 2B.

At least one deceleration gear may also be connected between the driving gear and the driven gear. In this case, the driving gear may be a worm gear.

The driver 100 may be provided at the hinge h2, or may be provided at the fan housing 52. In FIGS. 2A and 2B, the driver 100 is provided at the fan housing 52.

When the air conditioner starts operating, as the fan housing 52 rotates counterclockwise, as shown in FIG. 2B, the heat exchanger 40 linked thereto rotates together with the fan housing 52.

Since the other end (i.e., the upper end) portion of the heat exchanger 40 is rotatably coupled to the upper portion of the rear panel 21 by the hinge h1, the hinge h3 between the heat exchanger 40 and the blower 50 moves in a front direction of the housing, the blower 50 slides upward along the vertical direction of the rear panel 21, and the heat exchanger 40 moves to an extended position that expands a heat exchange surface when the air conditioner is operating, as shown in FIG. 2B.

When the air conditioner is not operating, the fan housing 52 rotates clockwise, and the heat exchanger 40 and the blower 50, are aligned in parallel with each other along the vertical direction of the rear panel 21, as shown in FIG. 2A.

Improved efficiency may be achieved by extending the heat exchange surface forward when the air conditioner is operating and expanding a corresponding heat exchange area. When the air conditioner is not operating, the installation space required by the heat exchanger 40 and the blower 50, and more particularly, the overall thickness D of the housing, may be reduced to provide a more compact air conditioner.

Figure 3:
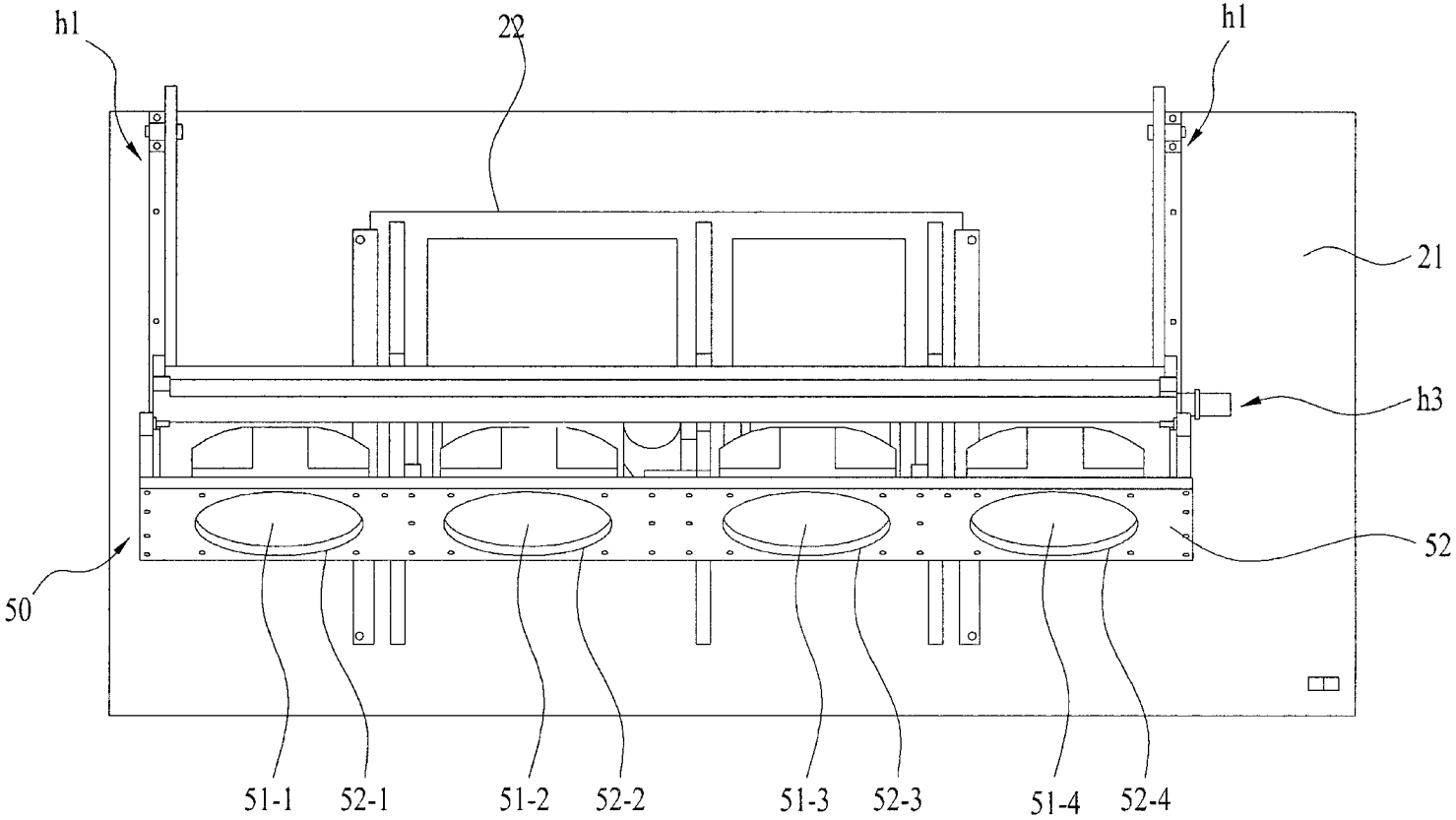
Figure 4:
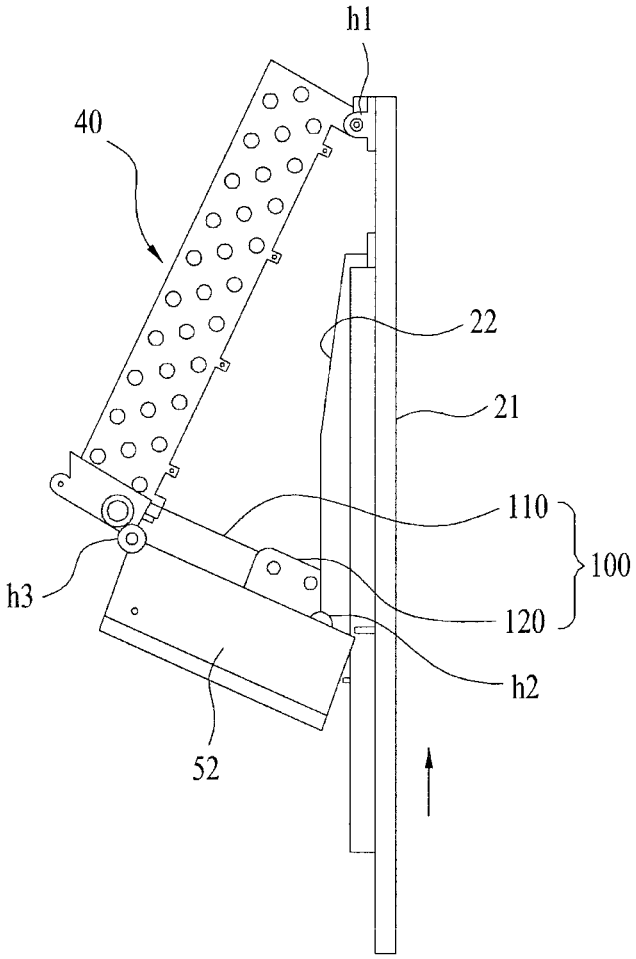
Figure 5:
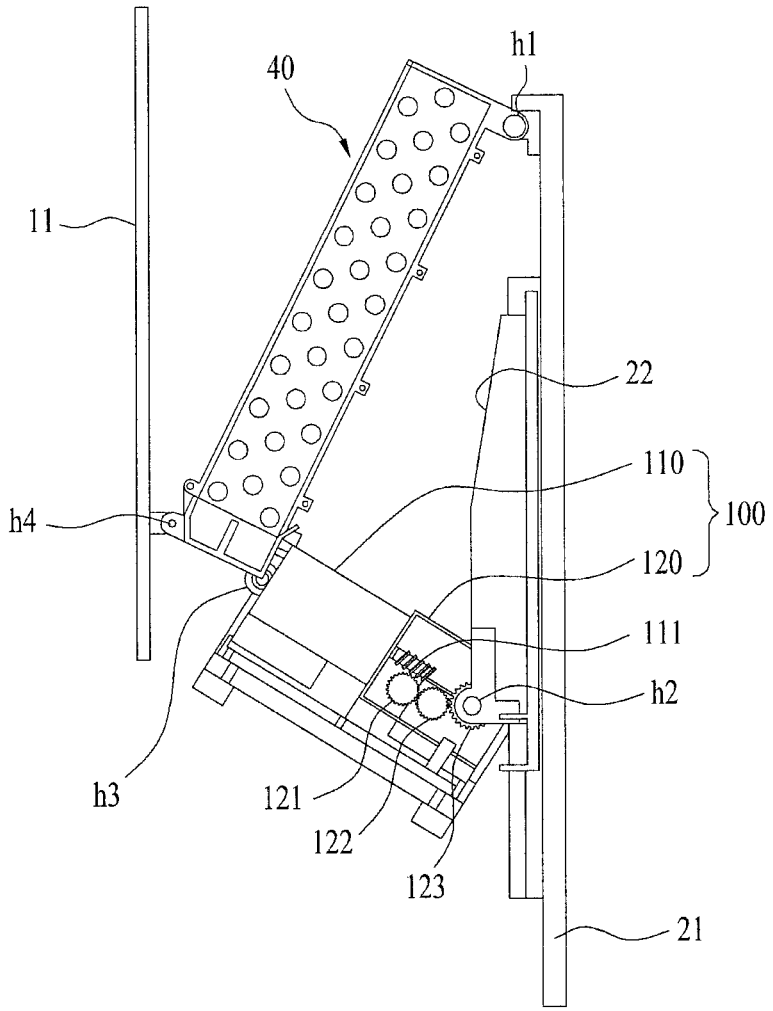

Referring to FIGS. 3 to 5, the guide rail 22 may be provided on the rear panel 21 to guide movement the fan housing 52 vertically along the rear panel 21. In the view shown in FIG. 3, the heat exchanger 40 is omitted, merely to provide a more clear view of the guide rail 22. A guide projection may be provided on the hinge h2 to engage the guide rail 22.

The fan 51 may include a plurality of fans 51-1 through 51-4 and the fan housing 52 may include a plurality of openings 52-1 through 52-4 spaced apart from each other along a horizontal direction and corresponding to the plurality of fans 51-1 to 51-4. In this case, each of the fans 51-1 to 51-4 may be, for example, a sirocco fan. By using a plurality of smaller fans, rather than one large fan, a predetermined blowing capacity may be provided by a blower 50 that occupies a smaller width, thus helping to minimize the overall width of the housing, in particular when the indoor unit 100 is not operating.

The adjacent end portions of the heat exchanger 40 and the fan housing 52 are rotatably linked with each other via the hinge h3. The other end portions of the heat exchanger 40 and the fan housing 52 are linked to the hinges h1 and h2, respectively, and rotatably coupled to the rear panel 21. In certain embodiments, a hinge h4 may rotatably link the adjacent end portion of the heat exchanger 40 or the fan housing 52 to the front panel 11, as shown in FIG. 5.

The driver 100 may rotate the hinge h2 between the fan housing 52 and the rear panel 21. The driver 100 may be provided with either the hinge h2 or the fan housing 52. In the interest of space utilization, and for ease of discussion hereinafter, it will be assumed that the driver 100 is provided on the fan housing 52.

The driver 100 may include a power generator 110 configured to generate a rotational force and a power transmitter 120 configured to transmit the generated rotational force to the hinge h2. The power generator 110 may include a motor and a driving gear 111 connected to the motor. The power transmitter 120 may include one or more deceleration gears 121 and 122 configured to engage with the driving gear 111 and a driven gear 123 provided on the hinge h2 engaged with the deceleration gears 121 and 122. The driving gear may be, for example, a worm gear, or other type of gearing system as appropriate.

Figure 6A:
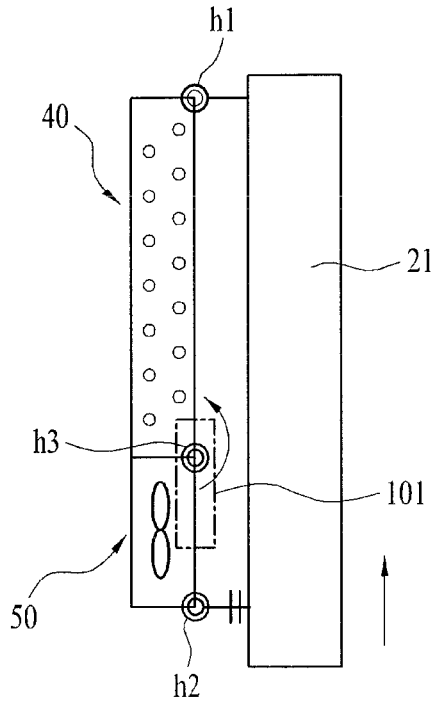
FIGS. 6 to 15 are cross sectional views of air conditioners as embodied and broadly described herein.
Figure 6B:
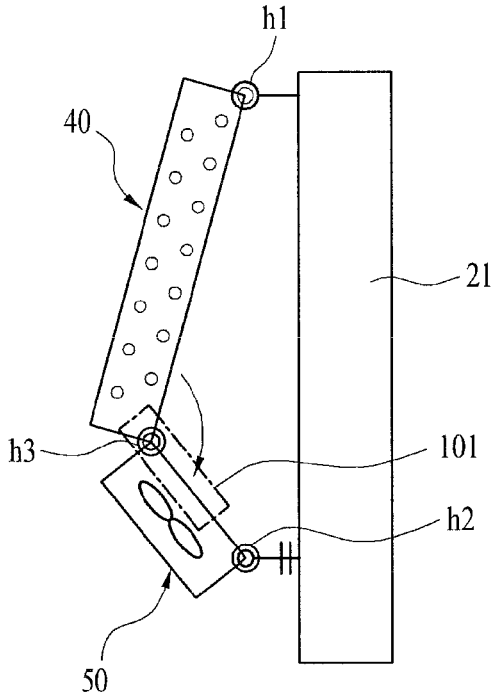

In the embodiment shown in FIGS. 6A and 6B, the heat exchanger 40 and the blower 50 are rotatably linked to each other by the hinge h3, and a driver 101 rotates the hinge h3 between the blower 50 and the heat exchanger 40. FIG. 6A shows the heat exchanger 40 and the blower 50 when the air conditioner is not operating. FIG. 6B shows the heat exchanger 40 and the blower 50 when the air conditioner is operating.

The linkages between the heat exchanger 40, the blower 50 and the rear panel 21 are substantially the same as those described with reference to FIG. 2. However, in this embodiment, the driver 101 is configured to rotate the hinge h3 between the blower 50 and the heat exchanger 40. The resulting rotational motions of the heat exchanger 40 and the blower 50 by the driver 101 are substantially the same as those explained in the foregoing description. In alternative embodiments, the driver 101 may be provided to the hinge h2 between the blower 50 and the heat exchanger 40.

Figure 7A:
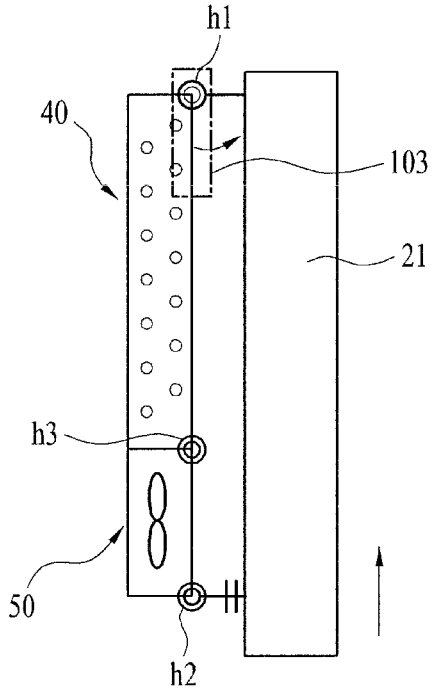
Figure 7B:
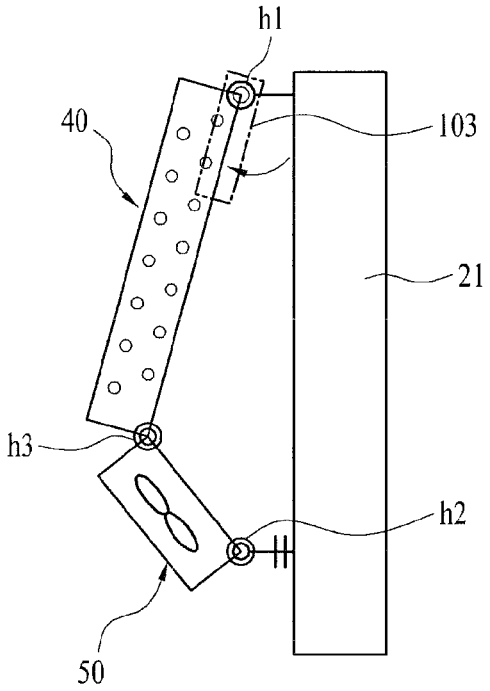

In the embodiment shown in FIGS. 7A and 7B, the heat exchanger 40 and the blower 50 are rotatably linked to each other by the hinge h3, and a driver 103 rotates the hinge h1 between the heat exchanger 40 and the rear panel 21. FIG. 7A shows positions of the heat exchanger 40 and the blower 50 when the air conditioner is not operating. FIG. 7B shows positions of the heat exchanger 40 and the blower 50 when the air conditioner is operating. The linkage relations among the heat exchanger 40, the blower 50 and the rear panel 21 are substantially the same as those described with reference to FIG. 2. In this embodiment, the driver 103 is configured to rotate the hinge h1 between the heat exchanger 40 and the rear panel 21. The rotational motions of the heat exchanger 40 and the blower 50 by the driver 103 are substantially the same as those explained in the foregoing description. The driver 103 may be provided on the hinge h1 between the heat exchanger 40 and the rear panel 21, or on the heat exchanger 40.

Figure 8A:
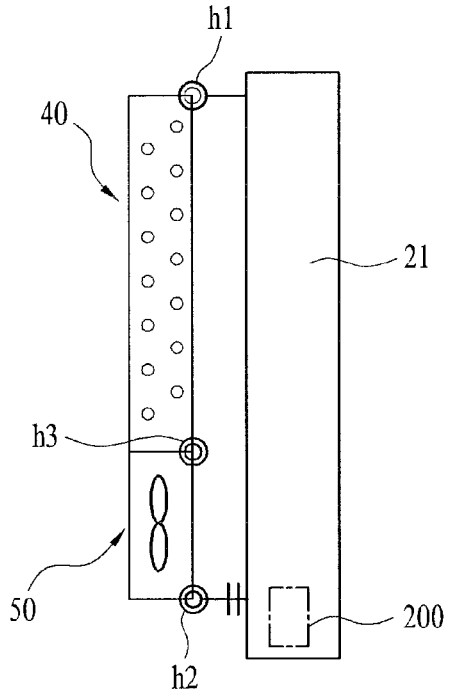
Figure 8B:
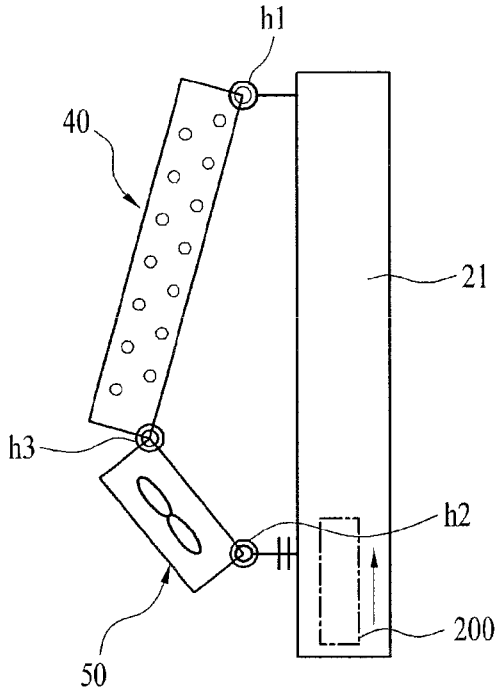

In the embodiment shown in FIGS. 8A and 8B, the heat exchanger 40 and the blower 50 are rotatably linked to each other by the hinge h3, and a driver 200 allows the hinge h2 between the blower 50 and the rear panel 21 to ascend or descend along a vertical direction of the rear panel 21. FIG. 8A shows positions of the heat exchanger 40 and the blower 50 when the air conditioner is not operating. FIG. 8B shows positions of the heat exchanger 40 and the blower 50 when the air conditioner is operating. The linkage relations among the heat exchanger 40, the blower 50 and the rear panel 21 are substantially the same as those of the embodiment described with reference to FIG. 2. In this embodiment, the driver 200 may be a linear driver that allows the hinge h2 between the blower 50 and the rear panel 21 to ascend or descend along a vertical direction of the rear panel 21.

When the air conditioner is operating, the linear driver 200 allows the hinge h2 to ascend along a vertical direction of the rear panel 21. Consequently, the hinge h3 between the heat exchanger 40 and the blower 50 is forced to move forward, as shown in FIG. 8B. On the contrary, when the air conditioner is not operating, the linear driver 200 allows the hinge h2 between the blower 50 and the rear panel 21 to descend along a vertical direction of the rear panel 21. Consequently, the heat exchanger 40 and the blower 50 are arranged in parallel along the vertical direction of the rear panel 21, as shown in FIG. 8A. The linear driver 200 may include, for example, a link member, a motor, a gear train, a cylinder or other linear device as appropriate.

The hinge h1 between the heat exchanger 40 and the rear panel 21 may instead slidably movable along a vertical direction of the rear panel 21 and the other end portion of the blower 50 may be rotatably coupled to the rear panel 21. In this case, the linear driver 200 allows the hinge h1 to ascend or descend along the vertical direction of the rear panel 21.

Figure 9A:
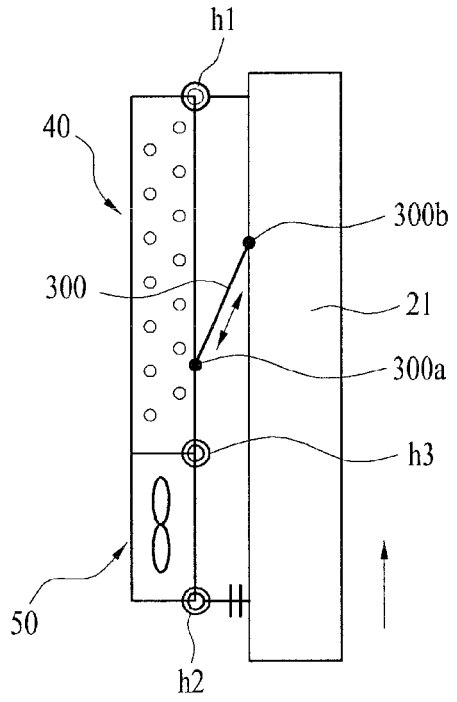
Figure 9B:
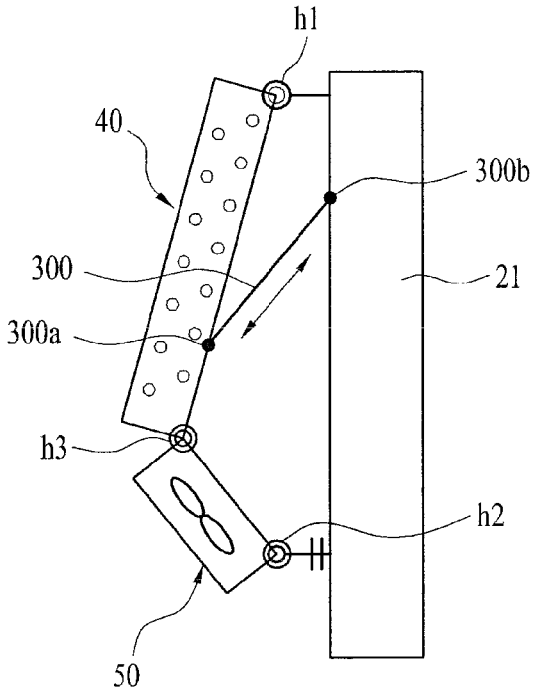
Figure 10A:
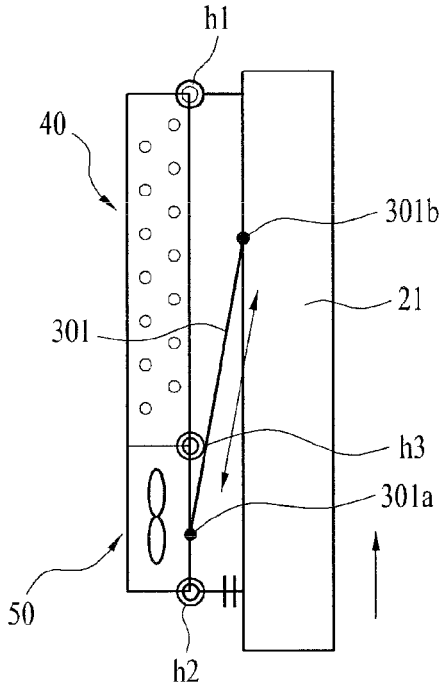
Figure 10B:
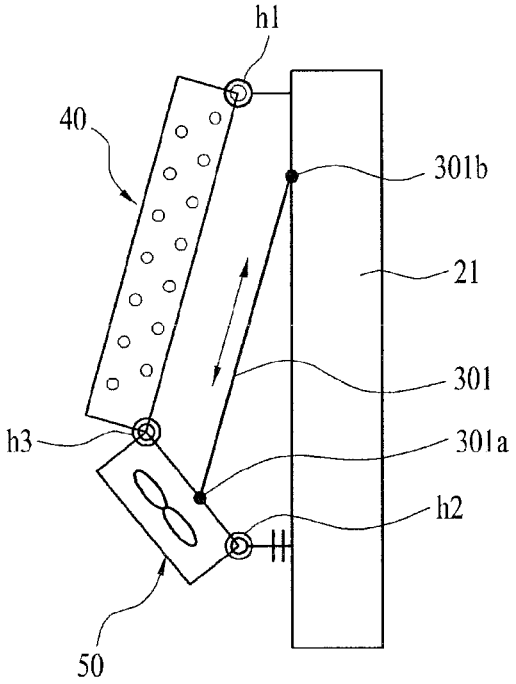
Figure 11A:
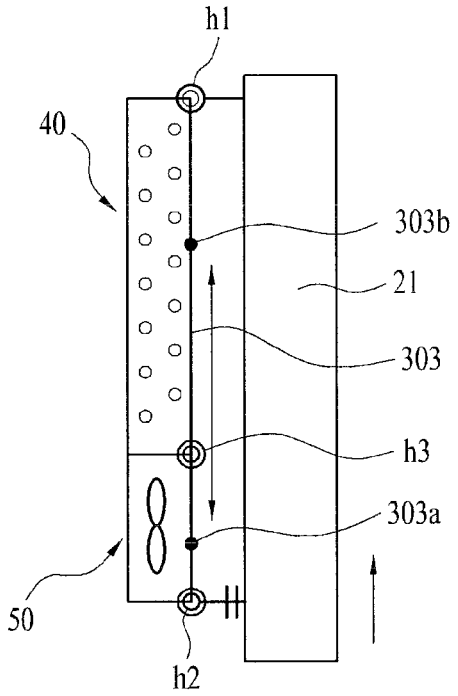
Figure 11B:
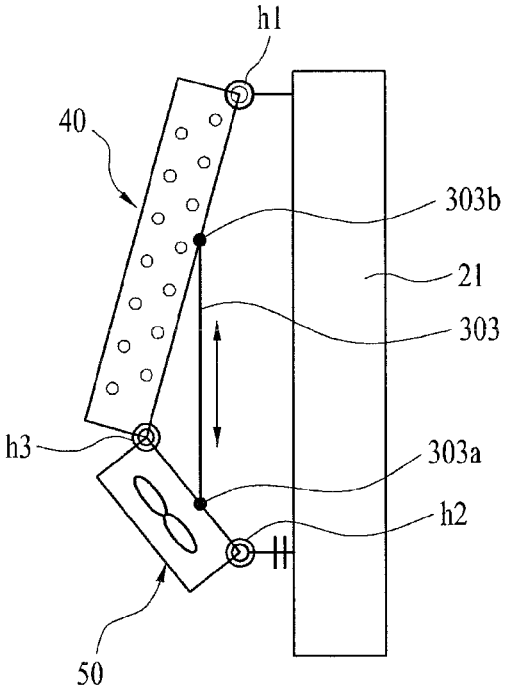

Various embodiments of systems for driving the heat exchanger 40 or the blower 50 are shown in FIGS. 9-11. In particular, FIGS. 9A, 10A, and 11A show a case in which the air conditioner does not operate and FIGS. 9B, 10B and 11B show a case in which the air conditioner operates. The linkage relations among the heat exchanger 40, the blower 50 and the rear panel 21 shown in FIGS. 9-11 are substantially the same as those described with reference to FIG. 2, with the driver being different.

Referring to FIGS. 9A and 9B, the driver 300 may include a linear driver linked between the heat exchanger 40 and the rear panel 21. The two opposite end portions 300*a* and 300*b* of the linear driver 300 are rotatably linked to the heat exchanger 40 and the rear panel 21, respectively so that an angle between the heat exchanger 40 and the rear panel 21 may be changed by the linear driver 300. As mentioned in the foregoing description, the linear driver 300 may be, for example, a link, a motor, a gear train, a cylinder and the like. One end portion 300*b* is rotatably linked to the rear panel 21, while the other end portion 300*a* is rotatably linked to the heat exchanger 40.

Therefore, referring to FIGS. 9A and 9B, if a length of the linear driver 300 increases when the air conditioner is operating, the angle between the heat exchanger 40 and the rear panel 21 increases, the hinge h3 between the heat exchanger 40 and the blower 50 moves forward, and the blower 50 ascends in a vertical direction of the rear panel 21, as shown in FIG. 9B. On the contrary, if a length of the linear driver 300 decreases when the air conditioner is not operating, the angle between the heat exchanger 40 and the rear panel 21 decreases, the hinge h3 between the heat exchanger 40 and the blower 50 moves in a rear direction, and the blower 50 descends in a vertical direction of the rear panel 21, as shown in FIG. 9A.

Referring to FIGS. 10A and 10B, driver 301 may include a linear driver linked between the blower 50 and the rear panel 21. As mentioned in the foregoing description, the linear driver 301 may be, for example, a link, a motor, a gear train, a cylinder and the like. One end portion 301*b* is rotatably linked to the rear panel 21, while the other end portion 301*a* is rotatably linked to the blower unit 50.

Therefore, if a length of the linear driver 301 increases when the air conditioner is operating, the blower 50 ascends in a vertical direction of the rear panel 21, the angle between the blower 50 and the rear panel 210 increases, and the hinge h3 between the heat exchanger 40 and the blower unit 50 moves in front direction of the housing, as shown in FIG. 10B. On the contrary, if a length of the linear driver 301 decreases when the air conditioner is not operating, the blower 50 descends in a vertical direction of the rear panel 21, the angle between the blower 50 and the rear panel 21 decreases, and the hinge h3 between the heat exchanger 40 and the blower 50 moves in a rear direction of the housing, as shown in FIG. 10A.

Referring to FIGS. 11A and 11B, a driver 303 may include a linear driver linked between the blower 50 and the rear panel 21. As mentioned in the foregoing description, the linear driver 303 may be, for example, a link, a motor, a gear train, a cylinder and the like. One end portion 303*b* is rotatably linked to the heat exchanger 40, while the other end portion 303*a* is rotatably linked to the blower 50.

Therefore, if a length of the linear driver 303 decreases when the air conditioner is operating, the angle between the heat exchanger 40 and the blower 50 decreases, the angle between the heat exchanger 40 and the rear panel 21 increases, and the blower 50 ascends in a vertical direction of the rear panel 21, as shown in FIG. 11B. On the contrary, if a length of the linear driver 303 increases when the air conditioner is not operating, the angle between the heat exchanger 40 and the blower 50 increases, the angle between the heat exchanger 40 and the rear panel 21 decreases, and the blower 50 descends in a vertical direction of the rear panel 21, as shown in FIG. 11A.

Air conditioners according to other embodiments as broadly described herein are shown in FIGS. 12 and 13.

Figure 12A:
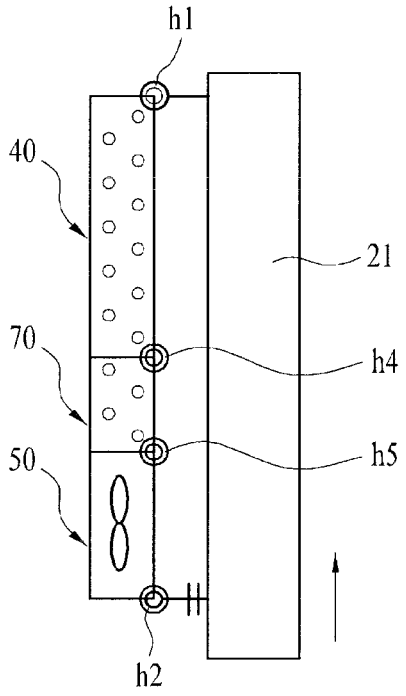
Figure 12B:
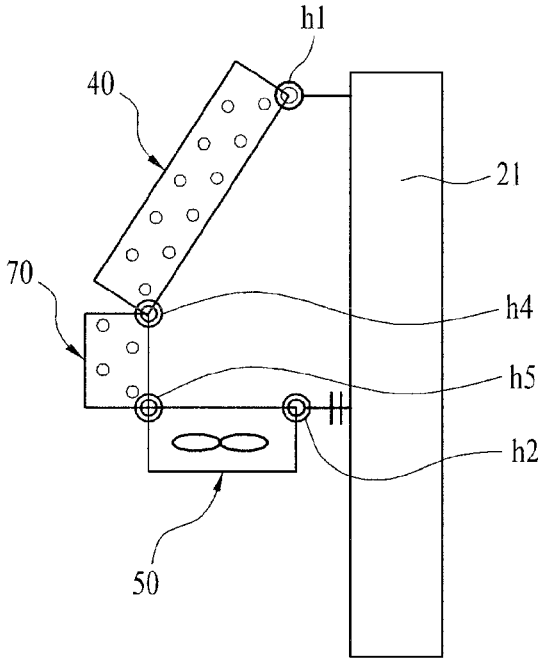

Referring to FIGS. 12A and 12B, an air conditioner as embodied and broadly described herein may include a drain pan 70 configured to receive condensed fluid generated by the heat exchanger 40. In this case, the drain pan 70 may be rotatably linked to the heat exchanger 40 and the blower 50 in series. In particular, the hinges h1 and h2 may rotatably link the heat exchanger 40 and the blower 50 with a top end and bottom end of the rear panel 21, respectively. And, the drain pan 70 may be rotatably provided between the heat exchanger 40 and the blower 50. Therefore, in a case in which one of the heat exchanger 40, the blower 50 or the drain pan 70 is moved by one of the above mentioned drivers, a volume occupied by each component and corresponding thickness of the air conditioner may be increased/decreased based on activation/deactivation of an air conditioning operation of the air conditioner.

Figure 13A:
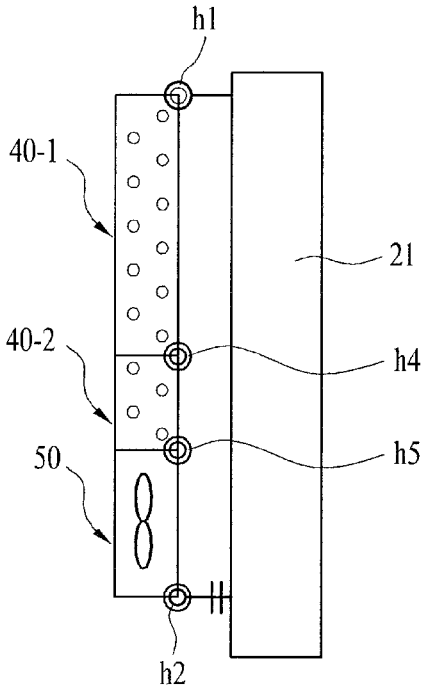

Referring to FIG. 13A, a first heat exchanger 40-1 and a second heat exchanger 40-2 may be sequentially connected in series via hinges h4 and h5 so as to be rotatable with reference to the hinge h1 provided at an upper end of the rear panel 21. One end portion of the blower 50 is linked to the rear panel 21 via the hinge h2 so as to slide and move along a vertical direction of the rear panel 21.

Figure 13B:
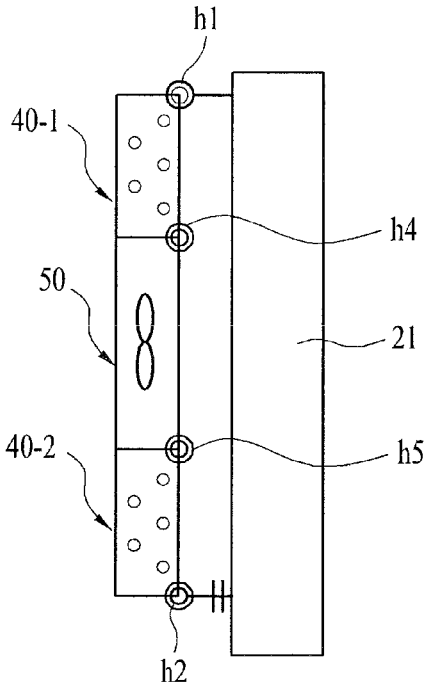

Referring to FIG. 13B, a first heat exchanger 40-1, the blower 50, and a second heat exchanger are sequentially connected via hinges h4 and h5 so as to be rotatable with reference to a hinge h1 provided at an upper end of a rear panel 21. One end portion of the second heat exchanger 40-2 is linked to the rear panel 21 via the hinge h2 to slide and move along a vertical direction of the rear panel 21.

Figure 13C:
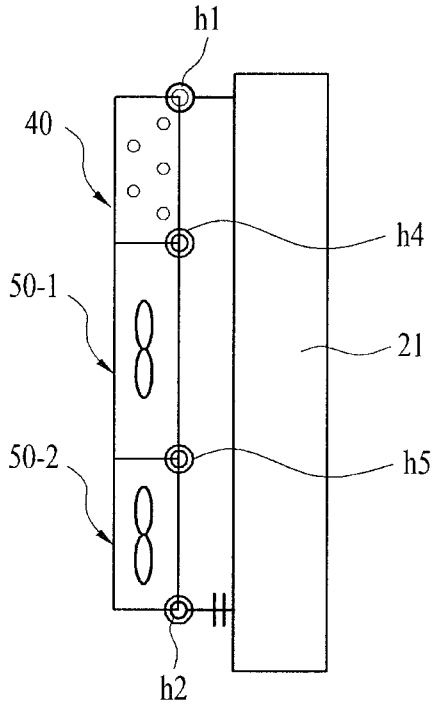

Referring to FIG. 13C, a heat exchanger 40, a first blower 50-1 and a second blower 50-2 are sequentially connected via the hinges h4 and h5 so as to be rotatable with reference to a hinge h1 provided at an upper end of a rear panel 21. One end portion of the second blower 50-2 is linked to the rear panel 21 via the hinge h2 so as to slide and move along a vertical direction of the rear panel 21.

Thus, the air conditioners shown in FIGS. 13A-13C may have a relatively high heat exchange efficiency by combining at least one or more heat exchangers 40-1 and 40-2 and/or at least one or more blowers 50-1 and 50-2. Moreover, when the air conditioner is not operating, a volume occupied by the components within the housing may be increased or decreased by moving one of the heat exchangers or the blowers using the driver.

Figure 14A:
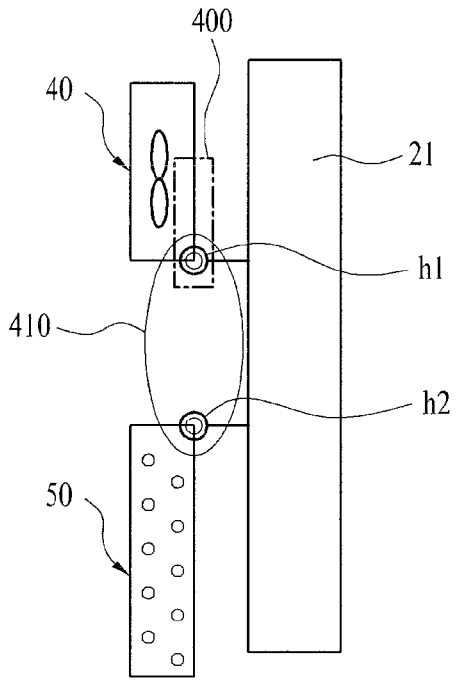
Figure 14B:
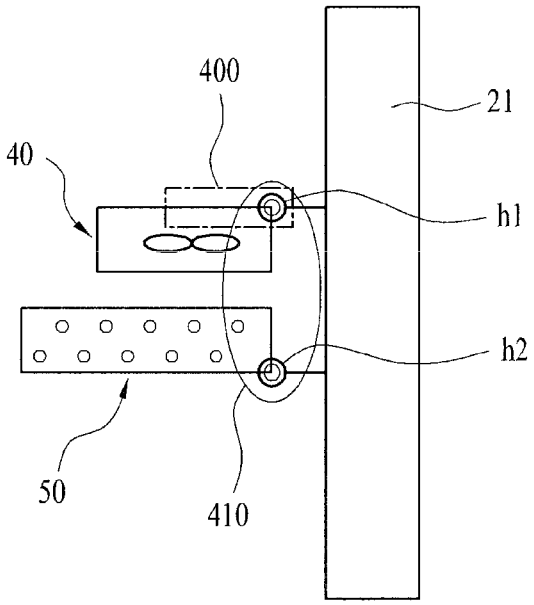

An air conditioner in accordance with another embodiment as broadly described herein is shown in FIGS. 14A and 14B, in which a heat exchanger 40 and a blower 50 are rotatably linked to a rear panel 21 via hinges h2 and h1, respectively. And, a driver 400 may rotate the hinges h1/h2 between the heat exchanger 40/blower 50 and the rear panel 21. Referring to FIG. 14A, the driver 400 may rotate the hinge h1 between the blower 50 and the rear panel 21. The hinge h1 and the hinge h2 between the heat exchanger 50 and the rear panel 21 may be linked with each other via a power transmission member 410 such as, for example, a belt, a chain and the like. Accordingly, referring to FIG. 14B, if the blower 50 is rotated as an air conditioning operation is initiated, the hinge h1 between the blower 50 and the rear panel 21 and the hinge h2 between the heat exchanger 40 and the rear panel 21 are rotated together by the power transmitter 410.

Figure 15:
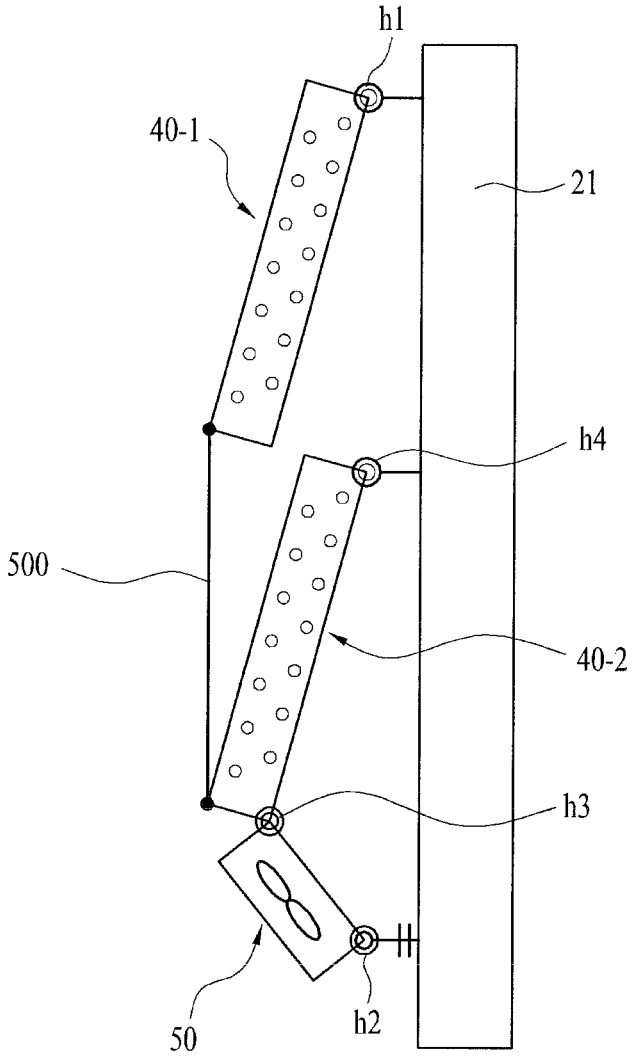

An air conditioner according to another embodiment as broadly described herein is shown in FIG. 15.

Referring to FIG. 15, a first heat exchanger 40-1 and a second heat exchanger 40-2 are rotatably linked with the rear panel 21 via the hinges h1 and h4, respectively. And, the first heat exchanger 40-1 and the second heat exchanger unit 40-2 may be linked with each other via a rotatable swing member 500. The second heat exchanger 40-2 is rotatably linked with a blower 50 via the hinge h3. And, the hinge h2 between the blower 50 and the rear panel 21 may slide and move along a vertical direction of the rear panel 21.

Therefore, if at least one of the second heat exchanger 40-2 or the blower 50 is moved by the above described driver, the first heat exchanger 40-1 linked with the second heat exchanger 40-2 is rotated together with the second heat exchanger 40-2. Thus, a plurality of heat exchangers or a plurality of blowers may be linked with a rear panel in series or parallel.

An air conditioner is provided in which high air conditioning efficiency and compact size can be provided in a manner of varying a location, angle or distance of a heat exchanger unit or a blower unit in case of air conditioning operation or deactivation of the air conditioner.

An air conditioner is provided in which the number of drive units for moving a heat exchanger unit or a blower unit can be reduced and by which reliability of the drive unit can be enhanced.

An air conditioner as embodied and broadly described herein may include a housing having a front panel and a rear panel spaced apart from the front panel, a heat exchanger unit disposed inside of the housing, the heat exchanger unit rotatably linked with at least one of the front panel and the rear panel, a blower unit disposed inside of the housing, the blower unit rotatably linked with at least one of the front panel and the rear panel. and a drive unit to rotate at least of the heat exchanger unit and the blower unit.

An air conditioner as embodied and broadly described herein provides high air conditioning efficiency and compact size in a manner of varying a location, angle or distance of a heat exchanger unit or a blower unit in case of air conditioning operation or deactivation of the air conditioner.

An air conditioner as embodied and broadly described herein reduces the number of drive units for moving a heat exchanger unit or a blower unit and enhances reliability of the drive unit.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a housing having a front panel and a rear panel forming an inner space therebetween;

a heat exchanger disposed inside the housing;

a blower disposed inside the housing, the blower rotatably coupled to the heat exchanger such that an angle is formed between the heat exchanger and the blower; and a driver that moves at least one of the heat exchanger or the blower such that an interior angle between the heat exchanger and the blower in a first mode is less that the interior angle therebetween in a second mode, wherein a distance between the front panel and the rear panel in the first mode is greater than a distance between the front panel and the rear panel in the second mode, so as to selectively increase or decrease a volume of the inner space of the housing, wherein the air conditioner is operated in the first mode, and the air conditioner is deactivated in the second mode, wherein adjacent end portions of the heat exchanger and the blower are rotatably coupled, wherein end portions of the heat exchanger and the blower opposite the respective adjacent end portions thereof are each rotatably coupled to a corresponding portion of the rear panel, and wherein at least one of a first hinge that rotatably couples the rear panel and the heat exchanger or a second hinge that rotatably couples the rear panel and the blower is slideable along a vertical direction of the rear panel.

2. The air conditioner of claim 1, wherein the second hinge is slideable along the vertical direction of the rear panel, and wherein the driver rotates at least one of the second hinge or the first hinge.

3. The air conditioner of claim 1, wherein the first hinge is slideable along the vertical direction of the rear panel, and wherein the driver rotates at least one of the first hinge or the second hinge.

4. The air conditioner of claim 1, wherein the driver rotates the first hinge.

5. The air conditioner of claim 1, wherein the driver comprises a motor, a driving gear connected to the motor, and a driven gear engaged with the driving gear and connected to one of the first hinge or the second hinge so as to rotate the one of the first hinge or the second hinge.

6. The air conditioner of claim 5, wherein rotation of the one of the first hinge or the second hinge causes the other of the first hinge or the second hinge to rotate.

7. The air conditioner of claim 5, the blower comprising:

a fan housing; and a plurality of fans installed in the fan housing, wherein the fan housing comprises a plurality of openings formed therein, spaced apart from each other in a horizontal direction so as to respectively correspond to the plurality of fans.

8. The air conditioner of claimer 1, the driver comprising a linear driver linked to the rear panel and one of the heat exchanger or the blower, wherein an angle between the rear panel and the one of the heat exchanger or the blower is changed as the linear driver is driven.

9. The air conditioner of claim 1, the driver comprising a linear driver linked to the heat exchanger and the blower, wherein an angle between the heat exchanger and the blower is changed as the linear driver is driven.

10. The air conditioner of claim 1, wherein the second hinge is slideable along the vertical direction of the rear panel, and wherein the driver comprises a linear driver configured to enable the second hinge to ascend or descend in the vertical direction.

11. The air conditioner of claim 1, wherein the first hinge is slideable along the vertical direction of the rear panel, and wherein the driver comprises a linear driver configured to enable the first hinge to ascend or descend in the vertical direction.

12. The air conditioner of claim 1, wherein the heat exchanger comprises a plurality of heat exchangers rotatably connected to one another in series.

13. The air conditioner of claim 1, further comprising a drain pan rotatably connected between the heat exchanger and the blower such that the heat exchanger and the drain pan are rotatably coupled to each other and the blower and the drain pan are rotatably coupled to each other, and wherein the heat exchanger and the blower are each linked to the rear panel.

14. The air conditioner of claim 1, wherein the heat exchanger and the blower are rotatably coupled to the rear panel by first and second hinges, respectively, and wherein the driver rotates the first hinge or the second hinge.

15. An air conditioner, comprising:

a housing having a front panel and a rear panel;

a heat exchanger disposed inside the housing;

a blower disposed inside the housing, the blower rotatably coupled to the heat exchanger such that an angle is formed between the heat exchanger and the blower;

a first hinge that couples a first end of the heat exchanger to the rear panel;

a second hinge that couples a first end of the blower to the rear panel;

a third hinge that couples adjacent second ends of the heat exchanger and the blower;

a guide installed on the rear panel; and a driver that changes the angle between the heat exchanger and the blower such that a distance between the front panel and the rear panel is changed, and a volume of an inner space formed in the housing is selectively increased or decreased accordingly, wherein the driver comprises:

a motor that generates a driving force; and gearing that transmits the driving force generated by the motor to the first hinge, the second hinge or the third hinge, wherein the gearing transmits the driving force to one of the first hinge or the second hinge, and wherein one of the first hinge or the second hinge is engaged with the guide so as to move along the guide and change the angle between the heat exchanger and the blower as the first, second and third hinges rotate in response to the driving force transmitted by the gearing.

16. The air conditioner of claim 15, further comprising a fourth hinge that couples the second end of one of the heat exchanger or the blower to the front panel, wherein the fourth hinge also rotates in response to the driving force transmitted by the gearing and moves the front panel toward or away from the rear panel based on a rotation direction of the motor.

17. The air conditioner of claim 15, wherein the heat exchanger and the blower are vertically aligned within the housing when a space between the front panel and the rear panel is minimized, and the heat exchanger and the blower are positioned at an incline when the space between the front panel and the rear panel is maximized.

18. The air conditioner of claim 15, wherein the driver comprises:

a motor that generates a driving force; and gearing that transmits the driving force generated by the motor to the second hinge, wherein the second hinge is engaged in a slide guide installed on the rear panel such that, as the second hinge rotates in response to the driving force from the motor, the second hinge moves within the slide guide and causes the first hinge and the third hinge to also rotate and the angle between the heat exchanger and the blower to change.

19. The air conditioner of claim 18, further comprising a fourth hinge that couples the second end of one of the heat exchanger or the blower to the front panel, wherein the fourth hinge also rotates the second hinge moves within the slide guide and moves the front panel toward or away from the rear panel based on a rotation direction of the motor.

20. An air conditioner, comprising:

a housing having a front panel and a rear panel;

a heat exchanger disposed inside the housing;

a blower disposed inside the housing, with adjacent end portions of the heat exchanger and the blower being rotatably coupled, and end portions of the heat exchanger and the blower opposite the respective adjacent end portions thereof being rotatably coupled to a corresponding portion of the rear panel; and a driver that moves at least one of the heat exchanger or the blower such that an interior angle between the heat exchanger and the blower in a first mode is less that the interior angle therebetween in a second mode, wherein at least one of a first hinge that rotatably couples the rear panel and the heat exchanger or a second hinge that rotatably couples the rear panel and the blower is slideable along a vertical direction of the rear panel.

* * * * *